United States Patent [19]

Welch

[11] Patent Number: 4,854,537

[45] Date of Patent: Aug. 8, 1989

[54] DISH DRAINER PLATFORM

[76] Inventor: Barry P. Welch, 122 S. Pine, Arcola, Ill. 61910

[21] Appl. No.: 179,307

[22] Filed: Apr. 8, 1988

[51] Int. Cl.[4] ..... A47B 91/00

[52] U.S. Cl. ..... 248/346; 4/656; 211/41; D32/56

[58] Field of Search ..... 248/346; 211/41; D32/55, 56, 57; 312/229; 4/656

[56] References Cited

U.S. PATENT DOCUMENTS

| | | | |
|---|---|---|---|
| D. 292,134 | 9/1987 | McDaniel, Sr. . | |
| 477,137 | 6/1892 | Mesick | 4/656 X |
| 1,025,178 | 5/1912 | Wingender | 211/41 |
| 1,185,677 | 6/1916 | Jargstorf | 211/41 X |
| 1,224,838 | 5/1917 | Blissman et al. | 4/656 X |
| 1,406,773 | 2/1922 | Stoffel | 211/41 |
| 1,446,592 | 2/1923 | Smythe | 211/41 X |
| 1,466,514 | 8/1923 | Smythe | 211/41 |
| 1,835,232 | 12/1931 | Lord | 211/41 X |
| 2,038,638 | 4/1936 | Brey | 4/656 |
| 2,443,404 | 6/1948 | Tallarico . | |

FOREIGN PATENT DOCUMENTS

| | | | |
|---|---|---|---|
| 20127 | of 1914 | United Kingdom | 211/41 |
| 721188 | 12/1954 | United Kingdom | 4/656 |

*Primary Examiner*—Blair M. Johnson
*Assistant Examiner*—David L. Talbott

[57] ABSTRACT

A platform for a dish rack (or separate dishes) wherein a leveling plate is used as a support surface. Water drains from the dishes through holes in the leveling plate, then onto a sloped floor within the platform. The floor is raised above the lower edge of the platform to provide clearance with respect to the rim area of a kitchen sink.

2 Claims, 1 Drawing Sheet

DISH DRAINER PLATFORM

BACKGROUND OF THE INVENTION

This invention relates to a platform for supporting a rack of dishes on a sink counter for draining water from the dishes into the sink.

Others in the field have devised various platforms for a generally similar purpose. For example, U.S. Pat. No. 2,443,404 to D. Tallarico shows a platform 10 for supporting a dish rack structure 16. U.S. Pat. No. Des. 292,134 shows a platform that is apparently designed to support a non-illustrated dish rack structure.

My invention is intended to be an improvement on the prior art platform structures.

SUMMARY OF THE INVENTION

I propose a platform structure that comprises a tray having a sloping lower wall (floor) for draining water from the dishes into a kitchen sink. A perforated leveling plate is removably disposed in the tray above the sloping wall for supporting the rack of dishes.

In my improved arrangement the sloping lower wall connects to a discharge spout leading from the tray into the kitchen sink. Both the sloping wall and spout are located above the lower edge (plane) of the tray, such that the spout can clear an upwardly projecting rim structure on the sink.

An important object of my invention is to provide a platform structure than can be used with sinks having peripheral rims that project above the adjacent counter top surface.

Another object is to provide a platform that includes a level support surface for a dish rack, thereby minimizing the possibility that dishes might slip from a heavily loaded dish rack.

A further object is to provide a platform that can be used at either side of a kitchen sink.

A still further object is to provide a platform that includes a discharge spout designed to depend into a sink bowl in such a manner as to confine water flow to the sink, as distinguished from the counter top or other non-desired zone.

An additional object is to provide a platform wherein the dishes are supported out of contact with the sloping lower wall of the tray, whereby the dishes are ensured of being completely drained.

THE DRAWINGS

DESCRIPTION OF A PREFERRED EMBODIMENT OF THE INVENTION

Figure 2:
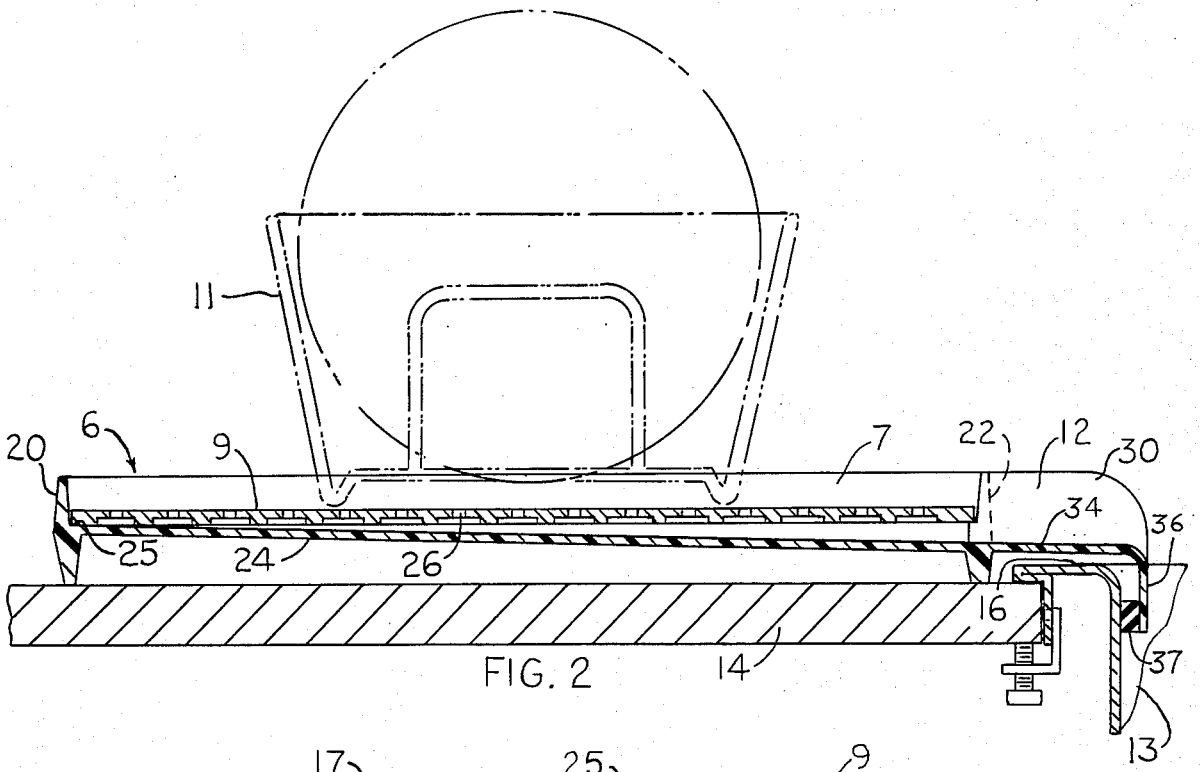
FIG. 2 is a sectional view taken on line 2—2 in FIG. 1. A dish rack (not part of my invention) is shown in phantom.
Figure 1:
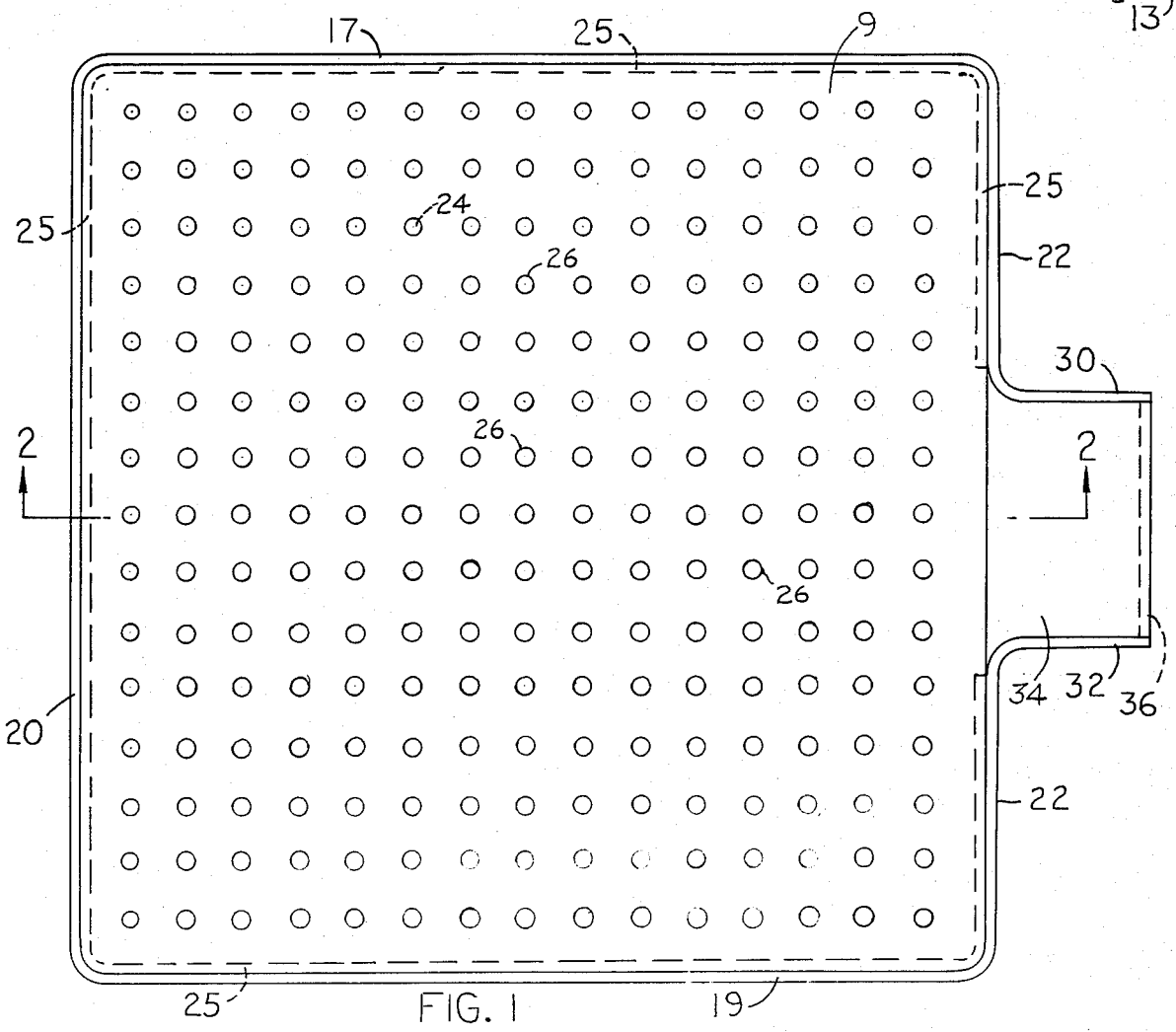
FIG. 1 is a top plan view of a platform structure embodying my invention.

The drawings show a dish drainer platform 6 comprising a rectangular tray 7 and perforated leveling plate 9 removably disposed therein; plate 9 is designed to support a conventional dish rack 11. A water discharge spout 12 extends laterally from tray 7 to a point above the bowl area of a kitchen sink 13. As shown fragmentarily in FIG. 2, the sink is of the "drop-in" type designed to fit into an opening in a counter top 14. Rim area 16 of the sink extends above the counter top upper surface.

Tray 7 comprises two spaced upstanding side walls 17 and 19, and two spaced upstanding end walls 20 and 22. The space circumscribed by these upstanding walls is occupied by a lower wall (floor) 24 that slopes slightly in a left-to-right direction, i.e. downwardly from the wall 20 to wall 22. Wall 22 is cut away in the area thereof leading to water discharge spout 12.

Upper inner surface areas of tray walls 17, 19, 20 and 22 are slightly recessed to form a horizontal ledge 25 above the general plane of slope wall 24. The aforementioned leveling plate 9 is removably disposed within the tray, with peripheral edge areas thereof resting on ledge 25. Plate 9 can be removed from the tray when necessary. The tray is preferably formed with a large number of holes (perforations) 26 therethrough; water drains from the dishes downwardly through holes 26 onto sloped wall (floor) 24, from whence it flows gravitationally into discharge spout 12.

Discharge spout 12 includes two upstanding walls 30 and 32, and a liquid transport wall 34. As seen in FIG. 2, wall 34 is a smooth continuation of tray lower wall 24. A terminal end section 36 of wall 34 extends downwardly to a point below the tray lower edge (upper surface of counter top 14); when the tray is disposed on a counter top wall section 36 depends into the bowl area of sink 13. An elastomeric seal member 37 is carried on wall section 36 to engage an inner side surface of the sink, thereby ensuring against undesired flow of water onto the countertop.

It will be noted that tray wall 24 and spout wall 34 are located in a general plane above the tray lower edge (bottom edges of walls 17, 19, 20 and 22). Also the space immediately below wall 34 is completely unobstructed. These constructional features ensure that the platform will remain clear of the sink rim 16, while still permitting a desired gravitational flow of water along floor 24 and spout wall 34. Vertical clearance dimension of about one-half inch is contemplated below wall 34.

The platform assembly can be formed of various different materials. However, it is preferred to form tray 7 and discharge spout 12 as a one piece molded plastic component. The separately-formed leveling plate 9 can be plastic or metal. Its lower face may have integral reinforcement ribs in a "honeycomb" design. Tray 7 and plate 9 are preferably sized large enough to support any conventional dish rack, with sufficient planar area to capture any drainage from dishes extending beyond the rack sides. Dishes can be placed directly on plate 9 if desired. A tray 7 area of about twenty inches on a side is contemplated. The tray height is on the order of one and one-half inch.

I claim:

1. A dish drainer platform comprising a rectangular tray defined by two spaced upstanding side walls, two spaced upstanding end walls, and a flat lower wall extending across the space circumscribed by said upstanding walls; said flat lower wall having a slight downward slope measured from one of the tray end walls to the other tray end wall, such that the flat upper face of said sloped wall serve as a liquid drain surface; a discharge spout extending away from said other tray end wall for conveying liquid from the sloped lower wall into a sink; said discharge spout comprising two spaced-apart upstanding side walls extending angularly from said other tray end wall at locations thereon spaced inwardly from the tray side walls, a liquid transport wall (34) extending as a smooth straight line continuation of the tray lower wall, and a downwardly extending terminal wall section (36) forming a smooth downward flow continuation of said liquid transport wall; the space between the spout side walls being unobstructed so that liquid can drain from the tray lower wall onto the liquid transport wall without encoutering any obstructions in the flow path; the spacing between the upstanding side walls of the discharge spout being substantially less than the spacing between the tray side walls so that the width of the spout is substantially less than the width of the tray; upper inner surface areas of the tray end walls and tray side walls being recessed to form a continuous horizontal ledge above the plane of the tray lower wall; and a perforated leveling plate removably disposed in the tray, with peripheral edge areas thereof resting on said horizontal ledge; said tray lower wall and liquid transport wall being spaced a significant distance above the lower edges of the tray end walls and side walls, so that an unobstructed free space is formed directly below the liquid transport wall; said platform being adapted for positionment on a horizontal sink counter surface, with the terminal wall section of the discharge spot located within the sink in near adjacency to a sink side wall; said unobstructed free space proving a clearance between the discharge spout and an upwardly projecting rim bordering the sink.

2. The dish drainer platform of claim 1, and further comprising an elastomeric seal means carried on the terminal wall section of the discharge spout to sealably engage a sink side wall without in any way obstructing the flow of drainage liquid from the discharge spout into the sink.

* * * * *